US009731162B2

(12) United States Patent
Martin

(10) Patent No.: US 9,731,162 B2
(45) Date of Patent: Aug. 15, 2017

(54) FREE-MOTION DYNAMIC RESISTANCE TRAINER FOR SPORTS AND REHABILITATION MOVEMENT TRAINING

(71) Applicant: Rephel Demarco Martin, Savannah, GA (US)

(72) Inventor: Rephel Demarco Martin, Savannah, GA (US)

( * ) Notice: Subject to any disclaimer, the term of this patent is extended or adjusted under 35 U.S.C. 154(b) by 124 days.

(21) Appl. No.: 14/858,108

(22) Filed: Sep. 18, 2015

(65) Prior Publication Data

US 2016/0008655 A1 Jan. 14, 2016

Related U.S. Application Data

(60) Provisional application No. 62/096,519, filed on Dec. 23, 2014.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/035*** | (2006.01) |
| ***A63B 69/00*** | (2006.01) |
| ***A63B 21/065*** | (2006.01) |

(52) U.S. Cl.

CPC ..... *A63B 21/4043* (2015.10); *A63B 21/0414* (2013.01); *A63B 21/0442* (2013.01); *A63B 21/0555* (2013.01); *A63B 21/0557* (2013.01); *A63B 21/065* (2013.01); *A63B 21/4005* (2015.10); *A63B 21/4007* (2015.10); *A63B 21/4011* (2015.10); *A63B 21/4013* (2015.10); *A63B 21/4015* (2015.10); *A63B 21/4019* (2015.10); *A63B 23/03575* (2013.01); *A63B 69/0028* (2013.01); *A63B 2069/0031* (2013.01)

(58) Field of Classification Search

CPC ..... A63B 21/00
USPC ..... 482/74, 75
See application file for complete search history.

(56) References Cited

U.S. PATENT DOCUMENTS

| | | | | |
|---|---|---|---|---|
| 5,176,377 A * | 1/1993 | Wilkinson | ..... | A63B 21/4025 482/114 |
| 6,132,346 A * | 10/2000 | Weeks | ..... | A63B 21/0004 482/124 |
| 6,280,365 B1 * | 8/2001 | Weber | ..... | A63B 21/018 482/124 |

(Continued)

*Primary Examiner* — Jerome W Donnelly

(57) ABSTRACT

A free-motion dynamic resistance trainer to be used to train the muscular coordination, dynamic stability and gait mechanics of athletes and physical therapy patients. Adjustable tension shock cords or bungee cords and resistance tubing are used in conjunction with a spinal support harness and jib in order to allow for the adjustment of progressive resistance and to create a heightened sense of proprioceptive awareness in those muscles and joints that are meant to be targeted depending upon the particular movement pattern being exercised. While providing resistance to improve strength and stamina, the shock cords or bungee cords and resistance tubing simultaneously guide and assist the trainee through certain aspects of each movement in order to train muscle memory of the proper kinetic sequence and body positioning. The apparatus, which is meant to be worn, can be used during sport specific movements other than running, in order to train and improve performance in myriad sports and activities.

14 Claims, 8 Drawing Sheets

(56) References Cited

U.S. PATENT DOCUMENTS 7,297,090 B2 * 11/2007 Torres ..... A63B 21/015
482/124
8,323,127 B2 * 12/2012 Webb ..... A63B 69/0002
473/422

* cited by examiner

FREE-MOTION DYNAMIC RESISTANCE TRAINER FOR SPORTS AND REHABILITATION MOVEMENT TRAINING

CROSS-REFERENCE TO RELATED APPLICATIONS

This application claims the priority of U.S. Provisional Patent Application No. 62/096,519 filed Dec. 23, 2014.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable.

STATEMENT REGARDING PRIOR DISCLOSURES BY THE INVENTOR OR A JOINT INVENTOR

Not Applicable.

BACKGROUND OF THE INVENTION

The present invention relates to a physical training apparatus to be used for the purpose of training persons such as athletes or physical therapy patients to improve various motor skills. More particularly, it relates to a physical training apparatus meant to be worn around the shoulders and torso of the trainee and which would, through the use of bungee cords and elastic tubing, provide varying degrees of tension and resistance to the trainee's torso and lower limbs during movement.

There are a number of circumstances that require precision of movement or where improving one's proprioception, kinesthetic awareness and neuromuscular facilitation can determine or improve a particular outcome. Resistance exercise and strength enhancement training in a way that promotes or improves natural motion or particular athletic movements can improve proprioception, kinesthetic awareness and neuromuscular facilitation and is thus beneficial to athletes and physical therapy patients alike.

Training with resistance while performing specific movements with the body has been found to be very effective in improving various physical abilities such as functional strength, running speed, first-step quickness, jumping ability, and kicking ability. Such resistance training is increasingly becoming favored over training with heavy weights using slow non-sports specific motions.

Elastic tubing, bungee cords and shock cords are commonly used devices for the purpose of providing resistance during movement and thus providing the impetus for muscles to grow or movement to be trained/re-trained or improved. In these instances the trainee can exert a force against the resistance of the elastic tubing or bungee cord as it stretches due to being secured or anchored to a stationary point at one end.

There are apparatuses, such as that found in U.S. Pat. No. 20,050,032,613 that incorporate elastic tubing and bungee cords for the purpose of providing resistance to oppose the motion of a trainee while either jumping, running or moving in a confined space. Other apparatuses utilize bungee cords attached at the ankle and waist in order to provide resistance to strengthen the posterior chain.

There remains a need in the art for a fully functional training device that, while strengthening and retraining those muscles in the lower limbs required for various movements, promotes isokinetic and isometric contractions as well as postural alignment during motion.

BRIEF SUMMARY OF THE INVENTION

Taking into account the shortcomings of prior art, the present invention is a functional free motion dynamic resistance trainer designed to allow trainees the freedom to improve muscular coordination and dynamic stability in order to create or augment particular muscle memory patterns without having to be assisted or towed in doing so.

In the preferred embodiment, the present invention is comprised of four main elements, the flexible adjustable spinal supporting apparatus with a Velcro waist band, the jib which is attached to the spinal support apparatus, shock cords or bungee cords meant to be attached to the jib at one end and either the trainee's legs/feet/ankles or hands at the other that can be adjusted to provide varying degrees of resistance, and resistance tubing meant to be enclosed inside a retractable pulley housing unit and attached to the aforementioned Velcro waist band and the back of the trainee's foot via an ankle strap.

The location and position of the shock cords or bungee cord creates both assisted and resisted movements in all three of the body's planes (sagittal, coronal, and transverse). Centering the jib as it is applies resistance to the particular limbs and muscles that support lifting and stabilizing actions when they are raised from caudal to cranial in every degree between the sagittal and coronal planes. As the limb is pressed back down to the ground, resistance is applied to the gluteal muscles and upper hamstrings by the elastic resistance tubing. The elastic resistance tubing also serves to accelerate the foot upward with approximately eight pounds of assistance, before the dorsally connected shock cords or bungee cords add resistance vertically. This antagonistic relationship also holds true when the limb is moved laterally distally away from the center axis. This cooperative set of bungee cords and tubing maximize independent movement and assure a greater degree of assistance and resistance so the body and its moving parts stay engaged throughout an entire series of movements, such as a running stride or a golf swing.

Accordingly, it is an object of the present invention to provide a free-motion dynamic resistance trainer that would promote improvements in a trainee's force output while also improving and strengthening the musculature directly tied to core coordination associated with postural alignment, balance, and gait.

It is another object of the present invention to provide a novel exercise apparatus that is meant to not impede the trainee's natural movement in anyway during use but rather encourage proper posture, movement mechanics and also allow for change of direction at will.

It is yet another object of the present invention to provide a free-motion dynamic resistance trainer that, when worn, would create a heightened sense of coordination of movement while simultaneously allowing for progressive strength training and the expression of forces through required specific ranges of motion.

It is a further object of the present invention to provide a free-motion dynamic resistance trainer that enables the training of biomotor abilities and gait mechanics.

It is yet a further object of the present invention to provide a free-motion dynamic resistance trainer that allows for the trainee to adjust the progressive resistance dependent upon height, weight, strength and skill and create a heightened sense of proprioceptive awareness of the engagement of the core muscles, hip flexors, posterior chain of muscles and lower limbs through various movements.

These and many other objects and advantages will be readily apparent to one skilled in the art to which the invention pertains from a perusal of the claims and the following detailed description of preferred embodiments when read in conjunction with the appended drawings.

BRIEF DESCRIPTION OF THE SEVERAL VIEWS OF THE DRAWING(S)

DETAILED DESCRIPTION OF THE INVENTION

Figure 1:
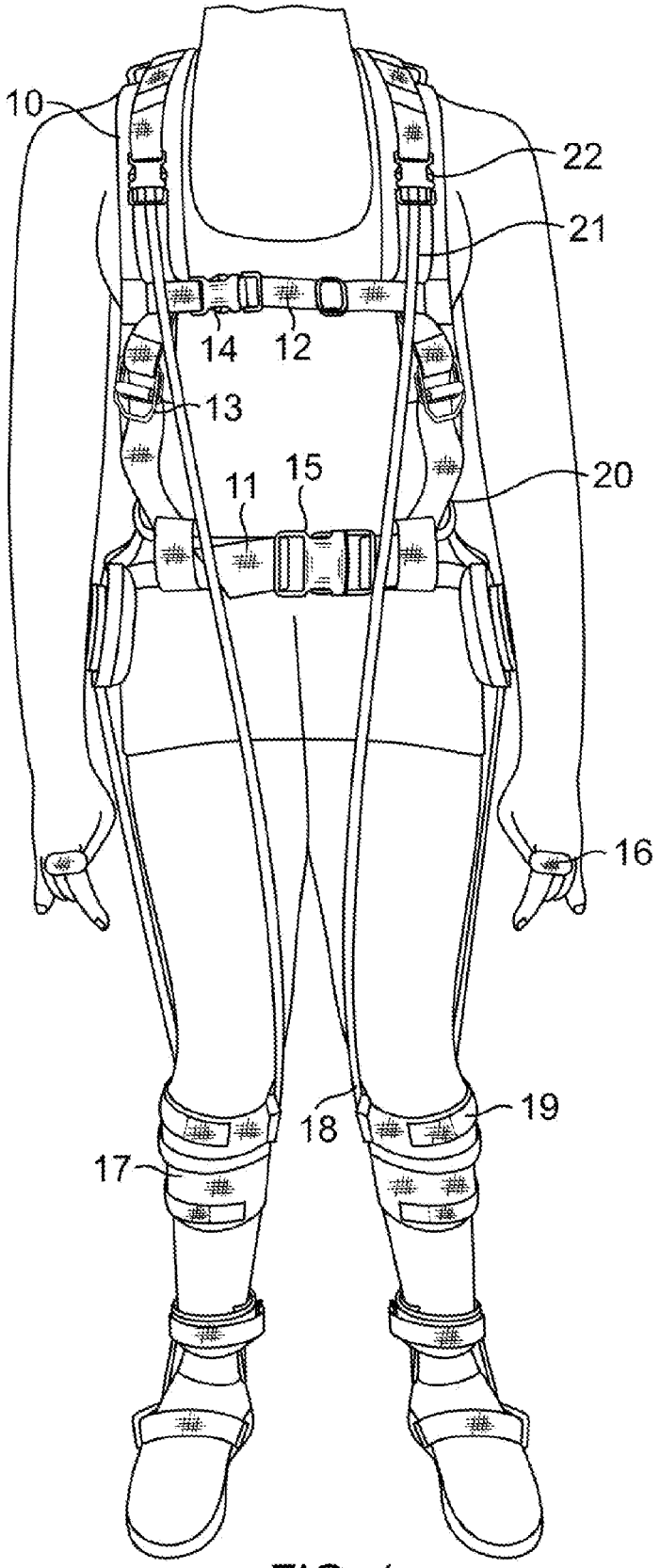
FIG. 1 is a front view of the present invention when worn by an individual, specifically illustrating the flex control spine support with front vertical band connections.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, all illustrations of the drawings are for the purpose of describing selected versions of the present invention and are not intended to limit the scope of the present invention.

Figure 2:
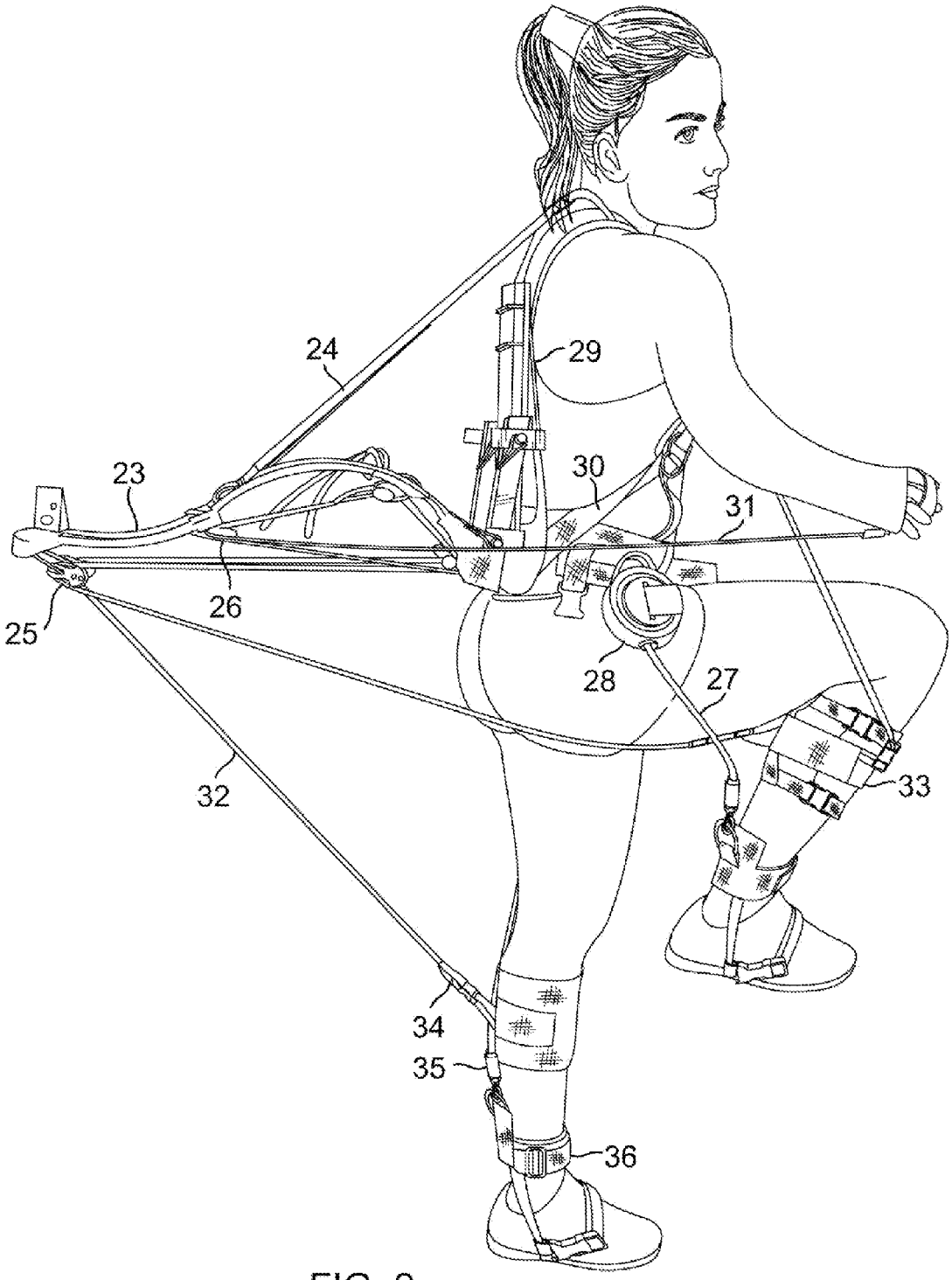
FIG. 2 is a full rear/side view of the present invention in its preferred embodiment.
Figure 3:
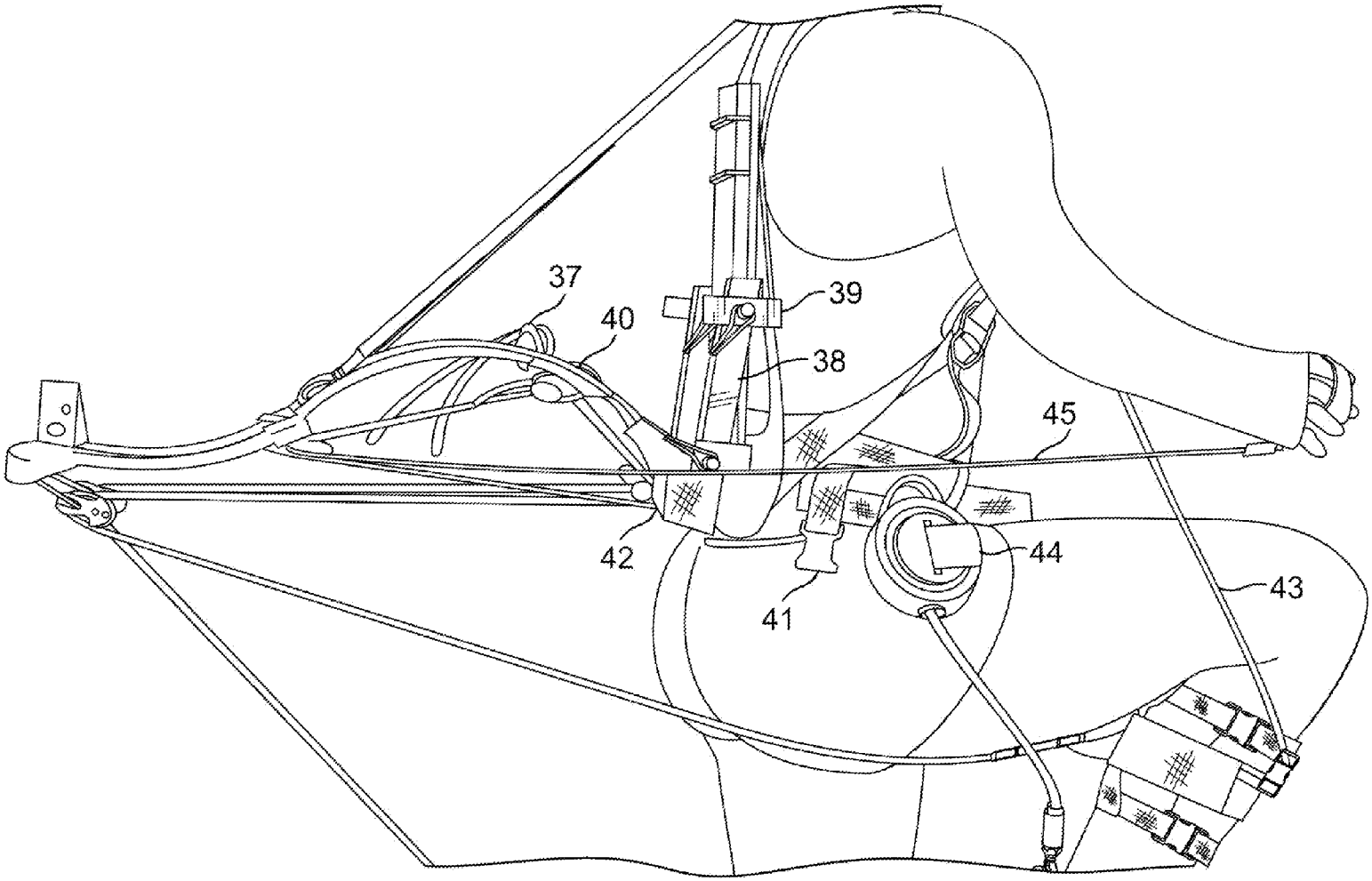
FIG. 3 is an expanded rear/side of the present invention in its preferred embodiment.
Figure 4:
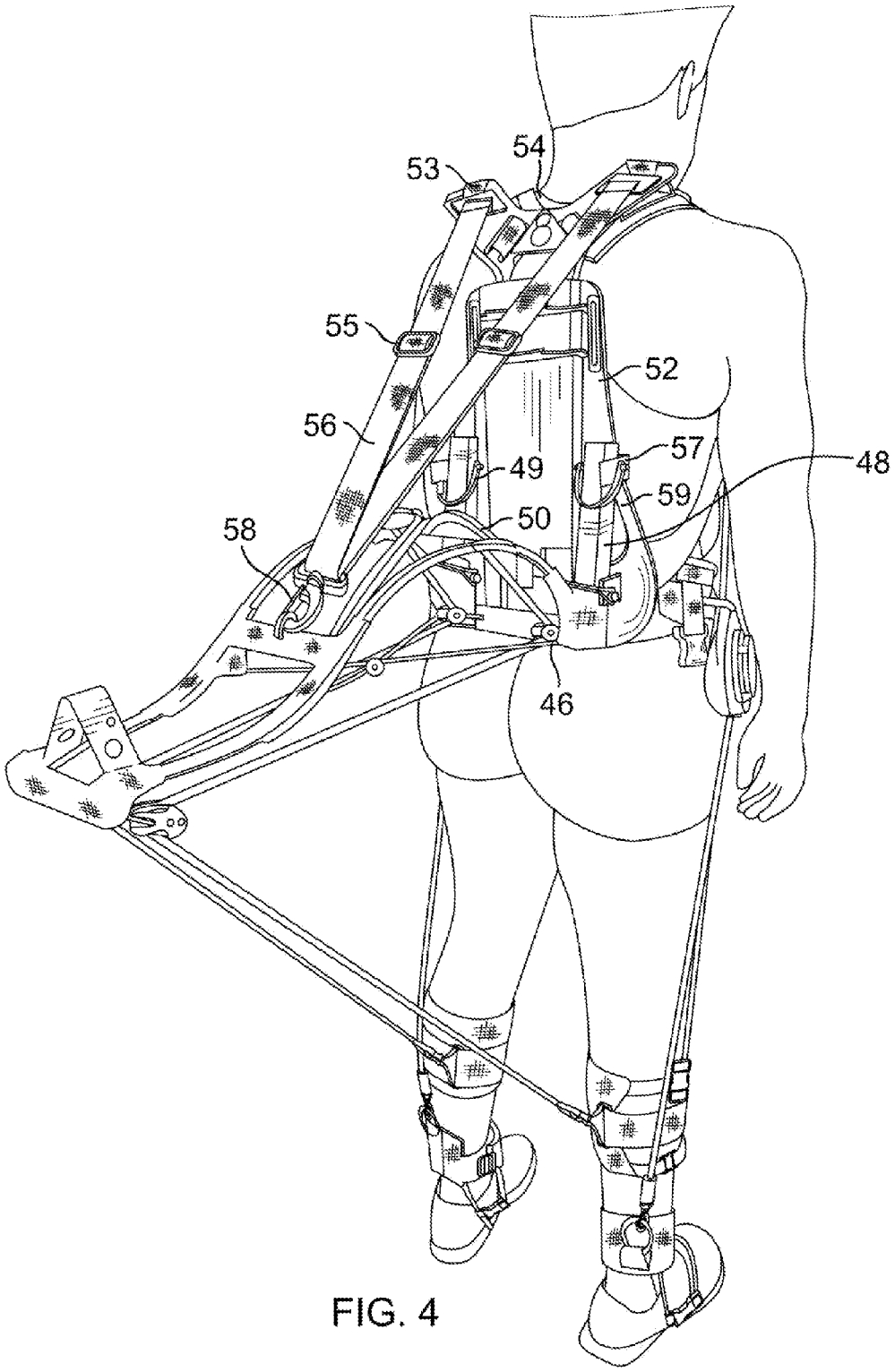
FIG. 4 is a rear/diagonal view of the flex control spine support and jib connections.
Figure 5:
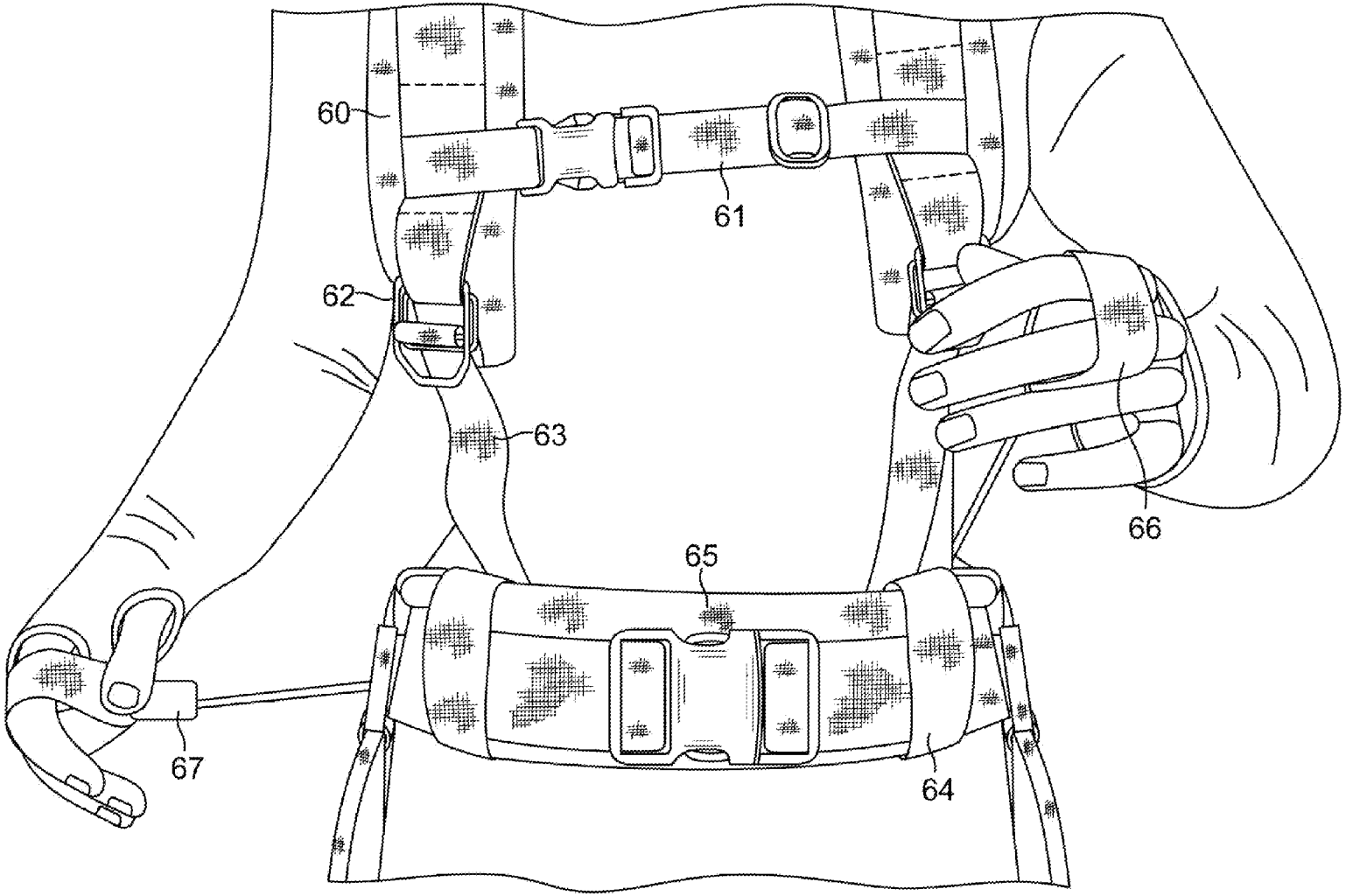
FIG. 5 is an expanded front view of the present invention when worn by an individual, specifically illustrating the flex control spine support with arm attachments.
Figure 6:
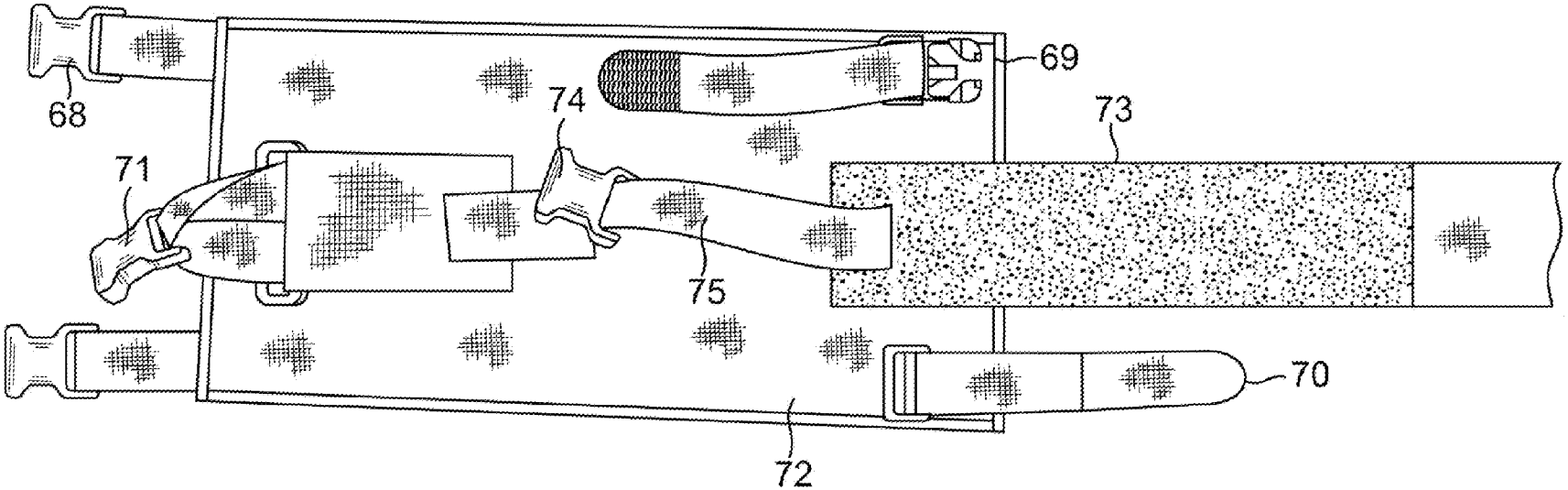
FIG. 6 is an expanded view of the Velcro compression leg support wrap.
Figure 7:
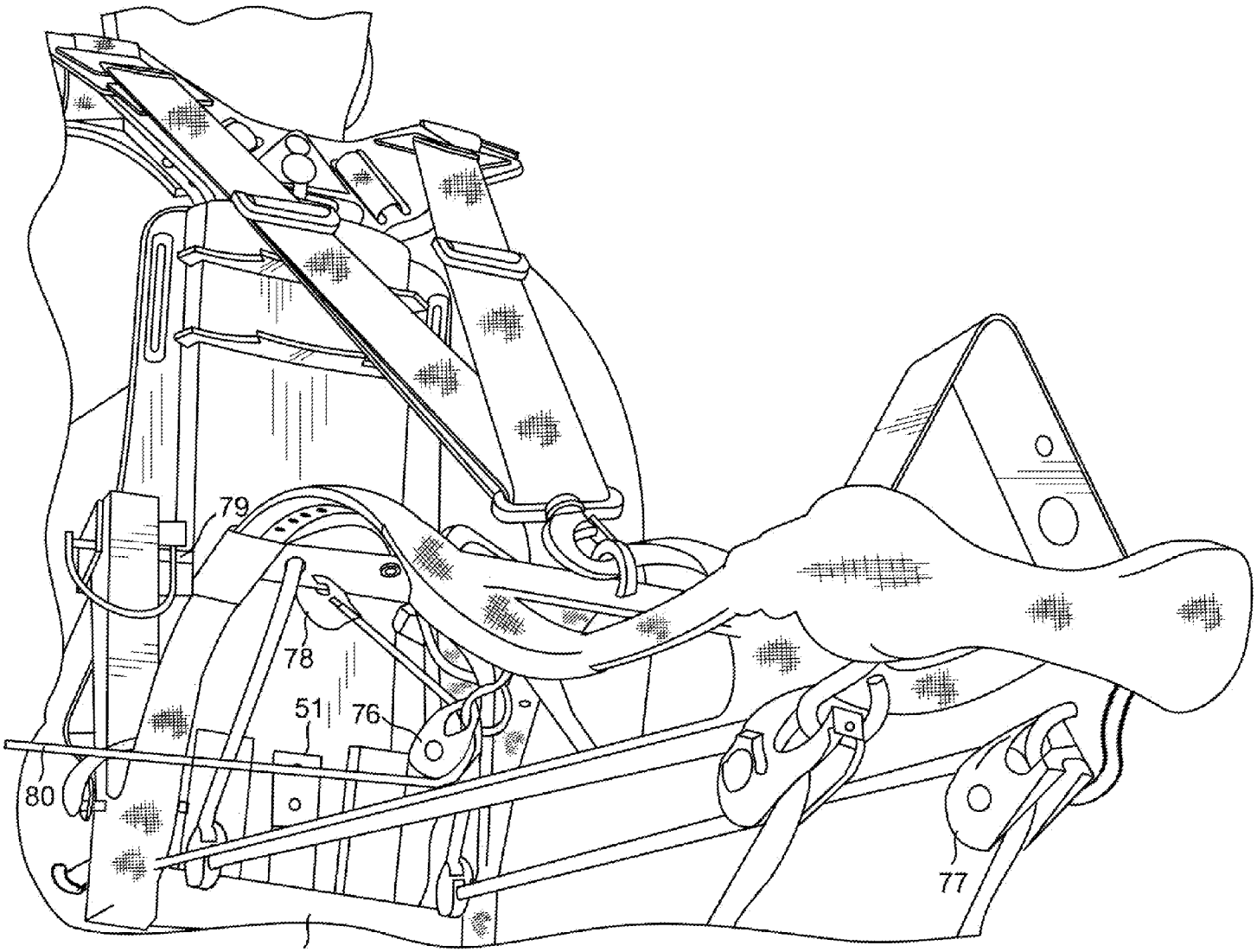
FIG. 7 is an expanded rear/diagonal/underneath view of the flex control spine support and jib connections.
Figure 8:
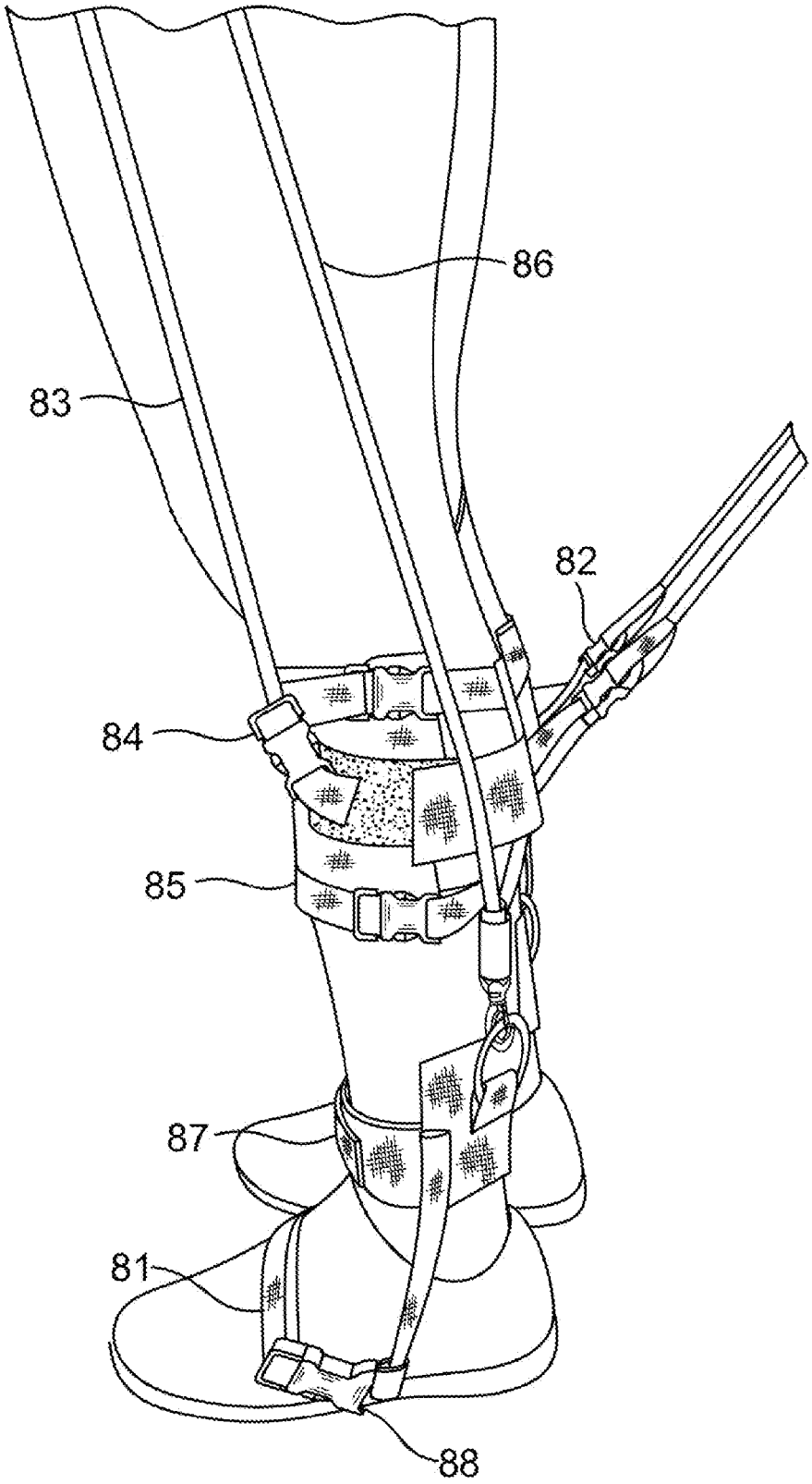
FIG. 8 is an expanded side view of the vertical/horizontal leg attachment connections.

This invention provides a wearable exercise apparatus as shown in FIGS. 1, 2, 3, 4 and 7. The invention, more specifically described as a free-motion dynamic resistance trainer, is an athletic and rehabilitation apparatus designed to develop or improve overall kinematic, sports specific and bio-mechanical rehabilitative movements. The invention is affixed to the body in such a way that it forces the trainee to engage the specific muscles generally associated with locomotion and stabilization. As such, the trainee is also able to better coordinate the psoas and glutei minimus muscles in particular, in addition to other smaller muscle groups required in all forms of movement and muscle reeducation. Referring to FIGS. 1-8, the present invention comprises a jib 23 made of aluminum, carbon fiber or plastic injection molded rods, a spinal brace 29 made of aluminum, carbon fiber or plastic injection molded parts, a plurality of Velcro straps (FIG. 6), a plurality of bungee cords 32, a plurality of resistance tubing 43, a plurality of pulleys 28, a plurality of screws, a plurality of eye bolts and a plurality of nuts.

The function of the jib 23 is to create an anchor or mounting point that is centered, behind, and away from the body's center of mass thus allowing for a horizontal mobile resistance point that could only otherwise be accomplished by use of a wall, pole, partner, or tethered device. This anchor or mounting point allows for resistance to be applied to any desired attachment point on a trainee's limbs. The jib 23 creates a point behind the trainee that is at once fixed, yet also fully free moving, to which resistance cords tubing, or bands can be attached via a pulley 25.

The spinal brace 29, made of any suitable material, includes a waist harness 64 and shoulder straps 60 so that it can be securely affixed to the body in a manner that also ensures good posture during exercise or activity.

The jib 23, which may vary in size depending upon the size of the free-motion dynamic resistance trainer (youth, mid-size, adult) with larger jibs being used in larger embodiments of the invention for larger trainees, is attached to the spinal support apparatus by a four-pinned wire lock pin system 49 mounted at the rear of the brace. Specifically, jib forks 48, made of beveled pipes and extending from the lower most point of the jib, are used to connect the jib to the spinal brace by use of wire lock pins 49. Jib straps 24 also connect the spinal brace's shoulder straps 20 to the end of the jib 23 that is farthest away from the body in order to provide additional resistance to the abdominals and back that is not obtained by the bungees and resistance tubing alone as their purpose is to provide resistance to the arms and legs. Once connected, the jib and spinal brace can operate as one unit, however, the use of a wire lock pin system 49 allows for the invention to be easily dismantled for traveling purposes.

In order to provide the necessary resistance, the shock cords or bungee cords 32 and resistance tubing 43 are attached vertically and horizontally to the jib 23 and/or spinal brace 29 with the orientation of each cord and tube serving a specific purpose. The primary vertical attachment is made by the resistance tubing which is housed in a retractable pulley unit 28 that is attached at the spinal brace's waist harness 64 (one on each hip). Extending downward from the hip, the resistance tubing attaches to the trainee at the ankle, via a dorsiflex ankle strap 87.

The primary distinguishing characteristics of the present invention is its localized function as it is attached to the user, thus enabling it to take make proper use of the center of pressure that is created from the antagonist relationship between the horizontal and vertical orientation of the various resistance bands and tubing 43. The present invention and this particular embodiment act as its own mobile tether and anchor point which is located at a distal point behind and away from the body and the body's center of mass thanks to the jib 23. Other resistance training apparatuses however, require an attachment point proximal to the body or are tethered to a distinct anchor point of some sort and work with either a vertical or horizontal resistance point rather than both. The present invention takes advantage of both horizontal and vertical resistance and allows the wearer to perceive a uniquely different perspective of resistance while accomplishing tasks at full speed and in complete multi-directional ranges of motion.

While a preferred embodiment of the present invention has been described, it is understood that the embodiment described is illustrative only and that the scope of the invention is to be defined solely by the appended claims when accorded a full range of equivalence, many variations and modifications naturally occurring to those skilled in the art from the perusal thereof.

What is claimed is:

1. A free-motion dynamic resistance trainer comprising:

a flexible adjustable spinal supporting apparatus;

a jib, having a first end and a second end, which is attached to the flexible adjustable spinal supporting apparatus;

four sets of shock cords or bungee cords for producing resistive force, each of said bungee cords having one end affixed to one of the trainee's limbs and the other end to the jib;

and resistance tubing, also affixed to the trainee at one end but to the flexible adjustable spinal supporting apparatus at the other.

2. The free-motion dynamic resistance trainer as defined in claim 1, further comprising ankle straps for the purpose of affixing one end of said resistance tubing to the trainee.

3. The free-motion dynamic resistance trainer as defined in claim 1, further comprising adjustable compression wraps for the purpose of affixing said bungee cords to the legs and/or arms.

4. The free-motion dynamic resistance trainer as defined in claim 1, further comprising one retractable pulley housing unit for each leg, connected to said flexible adjustable spinal supporting apparatus and in which said resistance tubing is housed in order to allow for varying length and resistance of said resistance tubing.

5. The free-motion dynamic resistance trainer as defined in claim 1, wherein the first end of said jib is attached to the bottom of said flexible adjustable spinal supporting apparatus via a jib fork.

6. The free-motion dynamic resistance trainer as defined in claim 1, wherein an adjustable jib strap attaches the second end of said jib to the top of said flexible adjustable spinal supporting apparatus via a jib fork.

7. The free-motion dynamic resistance trainer as defined in claim 1, wherein the shock cord or bungee cord is attached to the jib via a pulley.

8. The free-motion dynamic resistance trainer as defined in claim 1, wherein said flexible adjustable spinal supporting apparatus includes shoulder straps and a waist harness that are adjustable in size.

9. A free-motion dynamic resistance trainer comprising:

a flexible adjustable spinal supporting apparatus with adjustable shoulder straps, waist harness and a retractable pulley housing unit;

a jib which is attached to the flexible adjustable spinal supporting apparatus with a jib fork;

four sets of bungee cords for producing resistive force, each of said shock cords or bungee cords having one end affixed to the trainee and the other to the jib;

and resistance tubing, housed in the retractable pulley housing unit, which are also affixed to the trainee at one end but to the flexible adjustable spinal supporting apparatus at the other.

10. The free-motion dynamic resistance trainer as defined in claim 9 further comprising a jib fork stabilizing plate.

11. The free-motion dynamic resistance trainer as defined in claim 10 wherein said bungee cords are connected to said jib fork stabilizing plate with a connector hook.

12. The free-motion dynamic resistance trainer as defined in claim 9 wherein said retractable pulley housing unit is attached to said flexible adjustable spinal supporting apparatus via the waist harness.

13. The free-motion dynamic resistance trainer as defined in claim 9 wherein said shock cords or bungee cords are interchangeable for the purpose of either increasing or decreasing the intended resistance they provide.

14. The free-motion dynamic resistance trainer as defined in claim 9 wherein an adjustable chest strap is used to connect said adjustable shoulder straps for the purpose of further securing the apparatus on the trainee.

* * * * *